United States Patent [19]

Yanagi

[11] 4,054,099

[45] Oct. 18, 1977

[54] THREAD CUTTING MECHANISM FOR A SEWING MACHINE

[75] Inventor: Osamu Yanagi, Tokyo, Japan

[73] Assignee: Nara Sewing Machine Industrial Co., Ltd., Tokyo, Japan

[21] Appl. No.: 708,453

[22] Filed: July 26, 1976

[30] Foreign Application Priority Data

Oct. 20, 1975 Japan ..... 50-142664

[51] Int. Cl.[2] ..... D05B 65/00

[52] U.S. Cl. ..... 112/299

[58] Field of Search ..... 112/252, 130, 129, 122, 112/176; 83/902, 905

[56] References Cited

U.S. PATENT DOCUMENTS

| | | | |
|---|---|---|---|
| 118,467 | 8/1871 | Lord | 112/252 |
| 3,186,367 | 6/1965 | Greco | 112/252 |
| 3,565,026 | 2/1971 | Goosey | 112/252 |

*Primary Examiner*—H. Hampton Hunter

*Attorney, Agent, or Firm*—William Anthony Drucker

[57] ABSTRACT

A thread cutting mechanism is adapted to be attached by a bracket to a portion of the body of a sewing machine. The mechanism includes a cylindrical hollow tube on the peripheral wall of which the bracket is fixed, along the length of which a guide slot or groove of a given length is formed, and within which a compression spring is inserted. The tube is slidably engaged along its inner wall with an elongated operation rod having both ends projecting outwardly from the corresponding ends of the tube so as to enter into the center of the compression spring and having a pin slidably engaged in the guide slot or groove of the tube and normally pressed against the rear end of the guide slot or groove through the action of the compression spring. The front end of the operation rod is fitted with a cutter for severing a sewing machine thread. The thread cutting mechanism of the above-mentioned construction enables a portion of the thread which completes a required stitching work with the sewing machine to be easily cut off by the cutter, by pushing the operation rod in the forward direction by the stroke defined by the length of the guide slot or groove against the action of the compression spring and then releasing the operation rod so that the force exerted by the spring is removed.

2 Claims, 6 Drawing Figures

THREAD CUTTING MECHANISM FOR A SEWING MACHINE

BACKGROUND OF THE INVENTION

The present invention relates to a novel thread cutting mechanism for a sewing machine.

For convenience of explanation, a blind stitch machine will be hereinafter described. The conventional blind stitch machines are not generally provided with any thread cutting mechanism and it is preferable to provide the mechanism which will disengage the cloth from the operative portion of the thread without using tensile force exerted manually when the cloth is removed after completing the required stitching work.

However, in the blind stitch machine, a cloth is only stitched loosely by a machine thread.

For this reason, a high degree of skill always required to cut off the thread without disturbing the stitches of the cloth and consequently beginners frequntly produce the so-called twitch in the stitches of the cloth, in case of cutting by said tensile force, thereby causing damage to the work. This becomes more noticeable where a synthetic fiber thread such as nylon or Tetoron (trade name) is used for the machine. For this reason, in the prior art blind stitch machine, a portion of a thread after completing the desired sewing or stitching has been frequently cut off by use of conventional scissors in order to prevent the stitches of the cloth from being disturbed, resulting in remarkable lowering of the efficiency.

It is, therefore, the object of the invention to provide a novel thread cutting mechanism which has a relatively simple and inexpensive construction and enables a portion of a thread after completing the required stitching to be cut off as easily and speedily as possible without disturbing the stitches and decreasing the efficiency of work.

SUMMARY OF THE INVENTION

According to the invention, there is provided a thread cutting mechanism for a sewing machine comprising a cylindrical hollow tube on the peripheral wall of which there is secured one end of a bracket having its other end secured to the machine body, along the length of which tube a guide slot or groove of a given length is formed, and within which a compression spring is inserted; an operation rod has a pin slidably received in the guide slot or groove of the tube and both ends projecting outwardly from the corresponding ends of the tube so as to enter into the center of the compression spring; and a cutter for thread is fitted to one end of the operation rod.

The thread cutting mechanism of the above-mentioned construction has the advantage of enabling that portion of a thread which completes a desired stitching work with the sewing machine to be cut off as speedily and easily as possible substantially without disturbing the stitches, by pushing the other end of the operation rod against the action of the compression spring and thereafter immediately releasing the operation rod.

BRIEF DESCRIPTION OF THE DRAWINGS

There will now be described a preferred embodiment of a thread cutting mechanism in accordance with the invention with reference to the accompanying drawings, in which.

PREFERRED EMBODIMENT OF THE INVENTION

Figure 1:
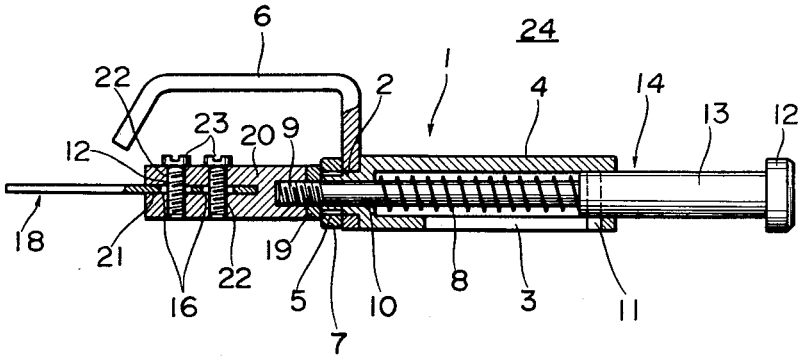
FIG. 1 is a schematic cross sectional view of a thread cutting mechanism in accordance with the invention.

In FIG. 1, reference numeral 1 denotes a cylindrical hollow tube with both ends open. The tube 1 comprises a relatively short section 2 of small diameter having, e.g., a length of about 7 mm, an inner diameter of about 5 mm and an outer diameter of about 8 mm; and a relatively longer section 4 of greater diameter extending integral from one end of the small section 2 and having, e.g., a length of about 46 mm, an inner diameter of about 7 mm and an outer diameter of about 10 mm. The larger section 4 is formed in its peripheral wall with a guide slot 3 having a given length and width, e.g., about 29 mm long and 4 mm wide. The peripheral wall of the tip of the small tube section 2 is formed with thread grooves 5 for fixing by means of a nut 7 one end of a bracket 6 having its other end attached to the body of a sewing machine (see FIG. 3). A compression coiled spring 8 is inserted within the larger tube section 4.

An elongated operation rod 14 is slidably engaged with the tube 1. The operation rod 14 comprises a small diameter section 10 having substantially the same diameter as the inner diameter of the small tube section 2 and a slightly greater length than the tube 1, e.g., about 78 mm long; and a large diameter section 13 integral with the rear end of the small section 10 and having a pin 11 provided at its front which is joined to the rear end of the small section 10 within the large section 4 of the tube 1, and slidably received in the guide slot 3 of the tube 1. Thread grooves 9 are formed at that front peripheral wall of the small section 10 of the operation rod 14 which projects outwardly from the small tube section 2 of the tube 1 under a normal state as shown in FIG. 1 in which no thread cutting operation is carried out.

The large section 13 is formed to have substantially the same diameter as the inner of the large diametric tube section 4 and a slightly greater length than the guide slot 3 of the tube 1. Thus, a flange 12 is integrally provided at that rear end of the large section 13 which projects outwardly from the large tube section 4 of the tube 1. Hence, the compression spring 8 is disposed over the lengthwise peripheral wall of the small section 10 of the operation rod 14 between the front inner wall of the large tube section 4 and the front end of the large diametric section 13.

Thus, the operation rod 14 is kept, under a normal state in which it is not pushed, as shown in FIG. 1, i.e., in which the pin 11 is pressed against the rear end of the guide slot 3 of the tube 1 through the action of the compression spring 8.

Figure 2:
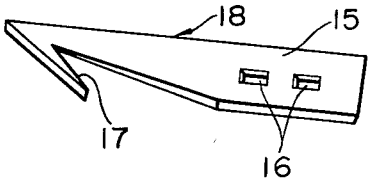
FIG. 2 is a perspective view of a cutter shown in FIG. 1.

Further, a cutter 18 as shown in FIG. 2 is provided in the base plate portion 15 in which two rectangular holes 16 are made at an interval and on the inner surface of whose hook shaped tip a cutting blade 17 is formed. The cutter 18 is secured in the hereinunder described manner to a cutter support member 20 whose rear end is secured by a lock nut 19 to the thread grooves 9 provided at that front peripheral wall of the small section 10 of the operation rod 14 which projects outwardly from the small tube section 2 of the tube 1. In the condition in which the base plate section 15 is received in a rectangular blind hole 21 at the front side of the cutter support member 20, the cutter 20 is fixed to the support member 20 by screwing respective screws 23 into two holes 22 bored in those vertical walls of the cutter support member 20 which face the corresponding rectangular holes 16 of the cutter 18. In this case, the attaching position of the cutter 18 to the support member 20 is finely adjustable by the aforesaid rectangular holes 16.

Figure 3:
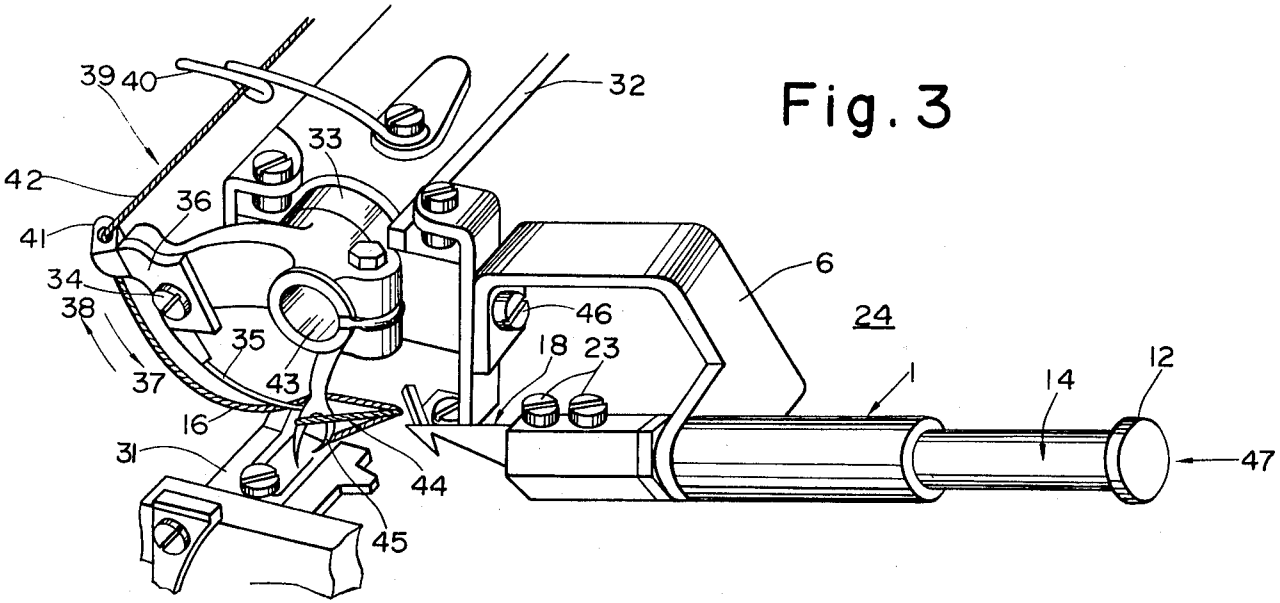
FIG. 3 is a schematic perspective view of the main part of a blind stitch machine having a thread cutting mechanism shown in FIG. 1.

FIG. 3 is a schematic perspective view of the main part of a blind stitch machine to which the abovementioned thread cutting mechanism is attached.

In this sewing machine structure the machine is provided with a presser foot 31 which is disposed at that upper surface of the body (not shown) of a blind stitch machine on which a cloth is to be stitched. A needle clamp 36 fixedly supporting the rear end of a needle 35 and tightened by means of a screw 34 is mounted at that end portion of a rotatable shaft 33 which extends through a frame 32 so as to approach the presser foot 31.

Thus, the shaft 33 actuates the needle clamp 36 around the shaft 33 and the needle clamp 36 in turn reciprocates the curved needle 35 laterally in the direction shown by an arrow 37 or 38 in FIG. 3.

A machine thread 42 is arranged to be continuously fed toward the tip of the needle 35 in accordance with the movement of the needle clamp 36 through an appropriate thread feeding assembly 39 comprising, e.g., a needle guide 40 secured to the upper wall of the frame 32 and a thread passing member 41 fixed to the needle clamp 36. There is further provided a looper 45 arranged to move around a shaft 43 in response to the movement of the needle clamp 36, whereby it serves to form that portion of the thread 42 continuously fed as mentioned above which confronts the tip of the needle 35 into a loop 44 and then cause the thread 42 to be caught by the tip of the needle 35 immediately before stitching.

The hook shaped tip portion of the cutter 18 as mentioned above can enter into the aforesaid loop shaped 44 of the thread 42 formed by the looper 45.

Figure 4A:
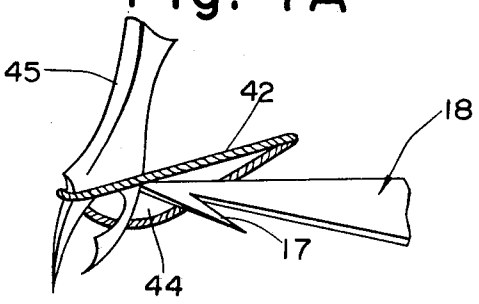
FIGS. 4A to 4C are schematic elongated perspective views on an enlarged scale respectively illustrating sequential processes of thread severing operation.
Figure 4B:
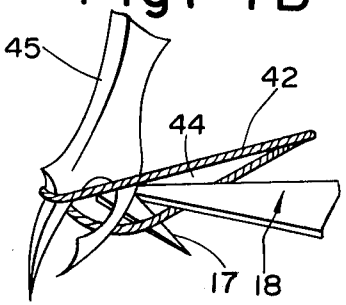

The blind stitch machine is operated in a conventional manner, and the thread cutting mechanism 24 secured as mentioned above to the machine can be moved to push the rear surface of the flange 12 of the operation rod 14 in the forward direction as shown by an arrow 47 in FIG. 3 by any finger, e.g., the thumb of right or left hand against the action of the compression spring 8 by the stroke by which the pin 11 is pressed against the front end of the guide groove 3 and then to release the operation rod 14, at the time when a required stitching is completed in accordance with the co-operation of the looper 45 with the thread feeding assembly 39 and needle clamp 36 and then the thread 42 is formed into the aforesaid looped shape 44 by the looper 45. In this case, as the operation rod 14 is pushed, the cutter 18 gradually approaches the looper 45 as shown in FIG. 4A from its normal or original position as shown in FIG. 3, and then its hook shaped tip portion enters, as shown in FIG. 4B, into the loop 44 of the thread 42 formed by the looper 45 at its foremost position at which the pin 11 is pressed against the front end of the guide groove 3 formed in the large tube section 4 of the tube 1. When, under this condition, the pushing force applied by the thumb to the rear surface of the flange 12 of the operation rod 14 is removed, then the operation rod 14 automatically moves along the inner wall of the tube 1 in the backward direction (see FIG. 4C) under the action of the compression spring 8, and is again kept at its rearmost position (see FIGS. 1 and 3) at which the pin 11 is pressed against the rear end of the guide groove 3, preparing the next operation.

Figure 4C:
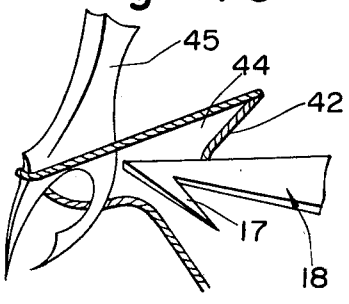

Thus, when the operation rod 14 moves in the backward direction as mentioned above, the front side portion of the loop 44 of the thread 42 is received by the hook shaped tip portion of the cutter 18. As the cutting blade 17 is formed on the inner surface of the hook shaped tip portion of the cutter 18, a portion of the thread 42 namely the front side portion of the loop 44 as shown in Fig. 4C after completing the required stitching can be easily cut off without disturbing the desired stitches formed in the cloth.

When the operation rod 14 reciprocates along the inner wall of the tube 1 as mentioned above, then the pin 11 always slides along the guide slot 3. For this reason, the operation rod 14 or the cutter 18 never rotates and consequently the orientation or direction of the cutting blade 17 of the cutter 18 should not change. Therefore, the thread cutting mechanism of the invention has the advantage of enabling the cutter 18 to reciprocate accurately within the smallest possible space and to cut off a portion of a thread after completing a desired stitching or sewing work without failure.

It will be easily understood by those skilled in the art that the thread cutting mechanism of the invention is not limited to the above-mentioned construction, but can have variations and modifications within the scope of the appended claims.

For example, it will be apparent that the thread cutting mechanism of the invention is also easily applicable to any other type sewing machines than the aforesaid blind stitch machine.

Further, in the above-mentioned embodiment, the cutting blade 17 is formed on the inner surface of the hook shaped tip of the cutter 18. However, the cutting blade 17 may be formed on the outer surface of the hook shaped tip of the cutter 18 and cut off a thread by the aforesaid pushing force applied to the operation rod 14.

Also, for the reciprocation of the operation rod 14, the guide slot or groove 3 may be formed in the operation rod 14 and consequntly the pin 11 may project from the inner wall portion of the tube 1.

What is claimed is:

1. A thread cutting mechanism, for attachment to the body of a sewing machine, comprising, in combination:

i. a cylindrical tube open at both ends ii. a bracket having a first end and a second end, said bracket being secured at said first end to the cylindrical tube, said second end being intended for securing to the body of the sewing machine iii. an operating rod disposed within said tube and having a first screwthreaded end projecting from one end of said tube and a second end projecting from the other end of said tube, said rod being freely slidable in said tube, iv. guiding and limiting means comprising a longitudinal guide recess and a lug engaged in said guide recess, the guide recess and the lug being provided one on one item of the assembly of tube and rod and the other on the other item of the assembly of tube and rod, v. spring means positioned within said tube and acting between said tube and said rod to urge said rod into a first limiting position of longitudinal sliding determined by said guiding and limiting means, vi. a cutter support member having a first end and a second end, said member having at said first end a threaded hole by which the member is engaged on the threaded end of the rod, said member having an elongated slot extending longitudinally from said second end, said member having two longitudinally spaced securing means extending transversely to said elongated slot, and vii. a cutter having a cutting edge, said cutter including a blade portion having two elongated holes positioned to correspond to the securing means of the support member, thereby to permit adjustment of the cutter longitudinally in the support member, and securing of the cutter in a predetermined position of adjustment.

2. A thread cutting mechanism, as claimed in claim 1, wherein said tube comprises first and second portions positioned end to end, said first portion being of relatively smaller external diameter, said second portion being of relatively greater external diameter, said second portion including said guide recess and receiving said spring, and wherein said operating rod comprises a first portion and a second portion disposed end to end, said rod first portion having its external diameter substantially the same as the internal diameter of the tube first portion, said rod second portion having its external diameter substantially the same as the internal diameter of the tube second portion, said guide lug being mounted on said rod second portion to project radially into said guide recess.

* * * * *